US006564471B1

(12) United States Patent
Sutherland et al.

(10) Patent No.: US 6,564,471 B1
(45) Date of Patent: May 20, 2003

(54) METHOD AND APPARATUS FOR FREEZE-DRYING

(75) Inventors: David T. Sutherland, Kingston, NY (US); Miriam Blednick, Gardiner, NY (US)

(73) Assignee: S. P. Industries, Inc., The Virtis Division, Gardiner, NY (US)

( * ) Notice: Subject to any disclaimer, the term of this patent is extended or adjusted under 35 U.S.C. 154(b) by 142 days.

(21) Appl. No.: 09/805,023

(22) Filed: Mar. 12, 2001

(51) Int. Cl.[7] ..... F26B 5/06

(52) U.S. Cl. ..... 34/284; 34/287; 34/289; 34/297; 34/92

(58) Field of Search ..... 34/284, 287, 289, 34/292, 293, 297, 92, 60, 62

(56) References Cited

U.S. PATENT DOCUMENTS

| | | | | |
|---|---|---|---|---|
| 3,382,586 A | | 5/1968 | Lorentzen | 34/92 |
| 3,537,233 A | | 11/1970 | Costello et al. | 53/264 |
| 4,178,697 A | * | 12/1979 | Sutherland | 34/92 |
| 4,197,658 A | * | 4/1980 | Fraser | 34/92 |
| 5,131,168 A | | 7/1992 | Rilke et al. | 34/5 |
| 5,398,426 A | | 3/1995 | Connor | 34/289 |
| 5,884,413 A | | 3/1999 | Anger | 34/92 |
| 5,884,414 A | | 3/1999 | Anger | 34/92 |
| 6,122,836 A | | 9/2000 | Tenedini et al. | 34/92 |

FOREIGN PATENT DOCUMENTS

| | | | |
|---|---|---|---|
| EP | 0 330 890 | 9/1989 | F26B/5/06 |
| WO | WO 95/10744 | 4/1995 | F26B/5/06 |

* cited by examiner

*Primary Examiner*—Jiping Lu
(74) *Attorney, Agent, or Firm*—Heslin Rothenberg Farley & Mesiti P.C.; John Pietrangelo

(57) ABSTRACT

A method and an apparatus for effecting freeze-drying specimens containing solvents or condensing solvents having a shallow pan treatment chamber with little or no obstructions, holes or orifices. The treatment is effected by cooling the base of the chamber by using coolant-containing coils mounted beneath the base of the chamber. The direct thermal conduction of heat through the base of the chamber provides a more effective method of both cooling specimens and condensing solvents, typically water. A source of vacuum is provided to the chamber by a conduit located in the cover, sidewalls or base of the chamber. The method and apparatus may employ a moveable specimen holder positioned in the chamber. The moveable specimen holder may be mounted on a perforated tube which slidably engages a conduit in the base of the chamber. The perforated tube may a conduit to the source of vacuum. The specimen holder may be supported by the perforated tube and by a rigid metal wire which is used to elevate the specimen holder above the base of the chamber. By varying the elevation of the specimen holder various treatments can be effected. The method and apparatus are applicable to manifold type freeze-drying and can be used simply as a cold trap.

38 Claims, 7 Drawing Sheets

METHOD AND APPARATUS FOR FREEZE-DRYING

TECHNICAL FIELD

This invention relates generally to apparatus and methods used for freeze-drying products or specimens. That is, the present invention relates to apparatus and methods for removing a solvent, typically water, from a specimen containing a solvent by first reducing the temperature of the specimen so that the solvent solidifies and then exposing the sample to subatmospheric pressures so that the frozen solvent sublimates with little or no generation of liquid solvent. Specifically, the present invention provides improved methods and apparatus for freeze-drying in which the process can be performed more quickly and more efficiently than conventional processes.

BACKGROUND OF THE INVENTION

Freeze-drying, which is also known as lyophilization, is the process of removing a solvent, typically water, from a product by sublimation and desorbtion. Though the laymen may associate the freeze-drying process with instant coffee, the process is typically applied to a broad range of medical, biological, and pharmaceutical products, typically for preservation of the product being treated. For example, some pharmaceutical compounds decompose in the presence of water and freeze-drying these compounds improves their stability and shelf life. Many parentereal medications, such as vaccines, proteins, peptides, and antibiotics, have been successfully freeze-dried. Many products in the burgeoning field of biotechnology are also amenable to freeze-drying and new developments in this field will increase the demand for freeze-drying methods and apparatus.

Freeze-drying typically is performed in a three-phase process: freezing, primary drying, and secondary drying. During the freezing phase, the goal is to freeze the solvent, typically water, of the product being treated. Significant supercooling of the liquid solvent may be encountered during the freezing step, so the temperature of the freezing step is typically much lower than the actual freezing temperature of the solvent to ensure that freezing (that is, solidification) of all the solvent present occurs. Cooling to temperatures below the freezing point of the solvent, for example, to temperatures of minus 40 degrees or below, better ensures that the specimen is "fully frozen". That is, cooling to these low temperatures minimizes the presence of any liquid in the specimen, for example, liquid eutectics interstitially located between other solidified components of the specimen, the presence of which can produce inferior freeze-dried products. The rate of cooling will influence the structure of the frozen matrix. The method of cooling will also affect the structure and appearance of the matrix and final product. Thus, in the freeze-drying process the regulation and control of the freezing process is very important to the quality of the resulting freeze-dried substance. According to one aspect of the present invention, the freezing phase of the freeze-drying process can be more efficiently regulated.

In the primary drying phase, the pressure to which the frozen sample is exposed is reduced, and then heat is applied to the product to cause the frozen solvent to sublime, or pass from a solid phase directly to a gaseous phase. The solvent vapor is collected, for example, on the surface of a condenser. The condenser must have sufficient surface area and cooling capacity to hold all of the solvent sublimated from the product sample. In addition, it is preferred that the surface temperature of the condensed solvent be lower than the product temperature. If the temperature of the condensed solvent on the condenser (for example, the ice formed on the condenser coils) is warmer than the product, solvent vapor will tend to flow toward the product and not the condenser and drying will stop. Of course, this is undesirable. According to another aspect of this invention, the location of the condensing surface provides enhanced condensation compared to the prior art.

It is important to control the drying rate and the heating rate during the primary drying phase. If the drying proceeds too rapidly, sublimation can occur too rapidly and the rapid release of gaseous solvent from within the product can violently eject some of the product out the container holding the product and result in unusable product. If the product is heated too rapidly, the product will melt or collapse. This may cause degradation of the product, and will certainly change the physical characteristics of the dried material, making it visually unappealing and harder to reconstitute. While frozen solvent is present, the product must be held below the eutectic temperature or glass transition temperature of the solvent.

After completion of the primary drying phase, there is typically no "mobile" liquid solvent remaining in the product. Thus, after the primary drying phase, the temperature of the freeze-dryer, for example, the shelf temperature, may be increased without causing melting. However, there may be immobile, trapped, or "bound" liquid solvent still present in the product. Therefore, to remove this bound solvent, the temperature can be increased to desorb the bound liquid solvent, such as the water of crystallization, until the residual liquid solvent content falls to the range required for optimum product stability. This phase of the freeze-drying process is referred to as "secondary drying". Secondary drying is usually performed at the maximum vacuum that the dryer can achieve, although there are products that benefit from increased pressures also.

Freeze-drying equipment has improved over the years, and, with the advent of automated, sophisticated control mechanisms, freeze-drying equipment has become much easier to use. However, there is still a need to improve the operation and maintainability of prior art freeze-dryers.

One prior art freeze-dryer over which the present invention is an improvement, is the ALPHA 1-2 freeze-dryer manufactured by Martin Christ of Osterode, Germany, for example, the freeze-dryer disclosed in the undated Martin Christ brochure entitled "ALPHA, The Freeze Dryer". For example, FIG. 1 of this brochure illustrates a shallow-pan freeze dryer having exposed cooling coils about its internal surface. Not only can the location and configuration of these coils interfere with the handling of specimens and the cleaning of the device shown, but exposed coils such as these are limited to cooling the specimens shown only by means of radiation and convection. This cooling at-a-distance is not as efficient or as effective as cooling by direct thermal contact with the specimen being cooled. In addition, the treatment chambers shown in this brochure typically include a plurality of ports or orifices, for example, for vacuum source access, coolant ingress and egress, and drains, that also require machining during fabrication and maintenance during use.

Regardless of the improvements made, existing methods and equipment for effecting freeze-drying still have limited cooling capacity, require multiple ports in the treatment chamber, and are cumbersome to use due to the presence of exposed cooling coils, among other disadvantages. The present invention provides enhanced methods and apparatus for freeze-drying which overcome these and other limitations of the prior art.

SUMMARY OF THE INVENTION

The present invention provides methods and apparatus which address many of the limitations of prior art methods and apparatus. Though the present invention can be adapted for large commercial processing, the present invention is typically applicable to "bench-top" applications, for example, for research or academic laboratories. The present invention can be designed to have an "ice capacity" of up to about 100 kg or more, but, typically the present invention has a capacity of less than 50 kg, for example, between about 1 and 10 kg. One embodiment of the present invention is a freeze-dryer comprising: a chamber having a cover, side walls and a thermally-conductive base, the base having an interior surface and a conduit therein; a specimen holder disposed in the chamber for holding a specimen to be freeze-dried, the specimen holder having a support tube slidably engaging the conduit so as to be selectively moveable between a position in which the specimen holder is in contact with the interior surface of the base and one or more positions in which the specimen holder is not in contact with the interior surface of the base; means mounted below the interior surface of the base for cooling the specimen; and means for reducing the pressure in the chamber by drawing a vacuum.

According to the present invention, an aspect that clearly distinguishes the present invention from the prior art, means for cooling the specimen cools the specimen primarily by conduction. Conduction cooling is much more efficient than radiation cooling or connective cooling as practiced in the prior art. For example, prior art freeze dryers which do not provide conduction cooling are typically limited to cooling samples to only minus 37 degrees C. in a single stage of cooling. The freeze dryer of the present invention can cool samples to about minus 40 degrees C. or about minus 50 degrees C., or to even colder temperatures in a single stage of cooling. For multiple-stage cooling, the present invention can cool to colder temperatures, and these colder temperatures can be typically 25–30% colder temperatures than the prior art for multiple-stage cooling. The means for reducing the pressure in the chamber may be any conventional means, but is typically a conventional vacuum pump operatively connected to the chamber.

Another embodiment of this present invention a method for freeze-drying a specimen containing a solvent in a chamber having a base with an interior surface, the chamber having a thermally-conductive specimen holder moveable between a position in contact with the interior surface of the base and one or more positions not in contact with the interior surface of the base; means for cooling mounted beneath the interior surface of the base; and a source of vacuum operatively connected to the chamber for reducing the pressure in the chamber, comprising: positioning the specimen holder so that it contacts the interior surface of the base of the chamber; placing the specimen on the specimen holder; operating the cooling means so as to cool the specimen at least by conduction to a temperature below the freezing temperature of the solvent; moving the specimen holder to a position out of contact with the interior surface of the base of the chamber; and reducing the pressure in the chamber by activating the source of vacuum to obtain a pressure in the chamber at which the solvent will sublime to produce a freeze-dried specimen. The specimen may be cooled by the cooling means of the chamber or may be cooled externally, for example, in a separate freezer. The method of the invention can be practiced using a specimen holder which includes a perforated support tube that slidably engages the conduit in the base of the chamber and wherein the pressure reducing step is practiced by drawing at least some of the vacuum through at least one of the support tube perforations. The invention may further include, prior to or simultaneously with the pressure reducing step, heating the specimen to promote sublimation of the solvent and condensing the solvent in the chamber.

One advantage of the present invention is that the freezing and drying steps can be performed in the same chamber, without requiring separate devices or chambers to carry out the freeze-drying process. In addition, according to the present invention, samples do not have to be individually handled, which is convenient for the operator and avoids undesirable melting or contamination of the sample due to human or instrument contact.

Another embodiment of the invention is a method for freeze-drying a specimen containing a solvent in a chamber having a moveable specimen holder mounted on a perforated tube, the tube slidably mounted in a conduit in the base of the chamber; means for cooling the specimen mounted beneath the base of the chamber; and a source of vacuum operatively connected to the conduit in the base of the chamber for reducing the pressure in the chamber, comprising: positioning the specimen holder so that it contacts the base of the chamber; placing the specimen on the specimen holder; cooling the specimen at least by conduction to a temperature of at least about minus 40 degrees C. using the cooling means; supporting the specimen holder above and out of contact with the base of the chamber; and reducing the pressure in the chamber by activating the source of vacuum and drawing a vacuum through the conduit and at least one of the tube perforations to obtain a pressure in the chamber at which the solvent will sublime to produce a freeze-dried specimen.

A still further embodiment of the invention is a specimen holder for use in a freeze-dryer of the type having a treatment chamber having a base and a conduit therein, comprising: a specimen tray having a top and a bottom for holding a specimen; a cylindrical tube mounted to the bottom of the specimen tray having at least one perforation, the cylindrical tube adapted to slidably engage the conduit in the base of the chamber; and means for supporting the specimen tray above the base of the chamber. Typically, the cylindrical tube is right circular cylindrical in shape though any conventional cross-section may be used. In addition, according to this embodiment, the at least one perforation in the cylindrical tube is a plurality of perforations. Also, the plurality of perforations may comprise at least one perforation having a first diameter and at least one perforation having a second diameter, smaller than the first diameter. The at least one perforation may also be a plurality of perforations equally spaced along the tube or the at least one perforation may be a first perforation proximal the bottom of the plate and having a first diameter, and a set of equally-spaced perforations distal the bottom of the plate having a second diameter, smaller than said first diameter. The means for supporting the plate may comprise a wire spring clip.

A further aspect of the present invention includes a freeze dryer for treating a specimen containing a solvent, comprising: a chamber having a cover, side walls and a thermally-conductive base, the base having an interior surface; means for reducing the pressure in the chamber whereby at least some of the solvent in the specimen sublimes to form a gaseous solvent; and means mounted below the interior surface of the base for cooling the interior surface of the base to provide a condensing surface for the solvent.

A further aspect of the present invention includes a freeze-dryer, for treating a specimen containing a solvent, comprising: a chamber for holding the specimen, the chamber having a cover, side walls and a thermally-conductive base, the base having an interior surface; means for a reducing the pressure in the chamber whereby at least some gaseous solvent is formed; means mounted below the interior surface for cooling the interior surface whereby at least some solvent solidifies on the interior surface during treatment; and means for deflecting the interior surface whereby the at least some solidified solvent is dislodged from the interior surface to facilitate removal of the solidified solvent from the chamber.

A still further aspect of the present invention is a method for freeze-drying a specimen containing a solvent in a chamber having a base with thermally-conductive, deflectable interior surface; means for cooling mounted beneath the interior surface of the base; and a source of vacuum operatively connected to the chamber for reducing the pressure in the chamber, comprising: locating the specimen in the chamber; reducing the pressure in the chamber by activating the source of vacuum whereby at least some solvent sublimes; cooling the interior surface of the base via the means for cooling; condensing at least some solvent on the cooled interior surface; and deflecting the interior surface of the base whereby at least some solid condensate is dislodged from the interior surface.

These and other aspects of the present invention will become more apparent upon review of the attached drawings, description below, and attached claims.

BRIEF DESCRIPTION OF THE DRAWINGS

The subject matter which is regarded as the invention is particularly pointed out and distinctly claimed in the concluding portion of the specification. The invention, however, both as to organization and method of practice, together with further objects and advantages thereof, may best be understood by reference to the following detailed descriptions of the preferred embodiments and the accompanying drawings in which:

DETAILED DESCRIPTION OF THE PREFERRED EMBODIMENTS

Figure 1:
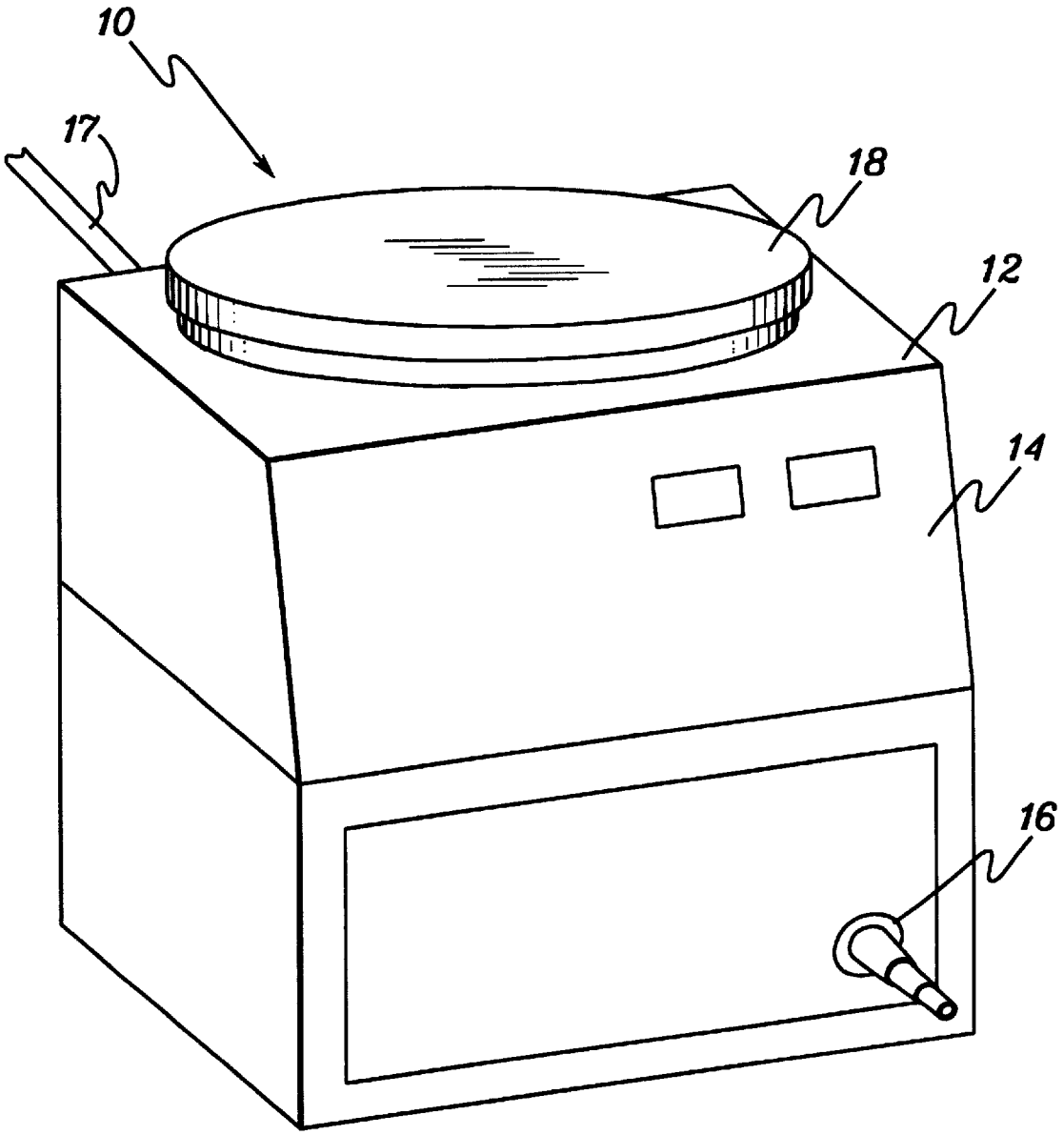
FIG. 1 is an isometric view of a typical freeze-drying device which incorporates the present invention.

FIG. 1 illustrates an isometric view of a freeze-drying device, or freeze-dryer, that employs the present invention. The specific device 10 shown in FIG. 1 is freeze-drying device marketed by The VirTis Company of Gardiner, N.Y. under the trademark BenchTop 2K™. The device 10 includes a housing 12, having a control panel 14, a drain port 16, and a vacuum port 17. The working chamber where specimens are placed is not illustrated in FIG. 1, but this chamber is isolated from the ambient environment by means of cover 18. Though also not shown, device 10 typically is supplied with electrical power by conventional means.

Figure 2:
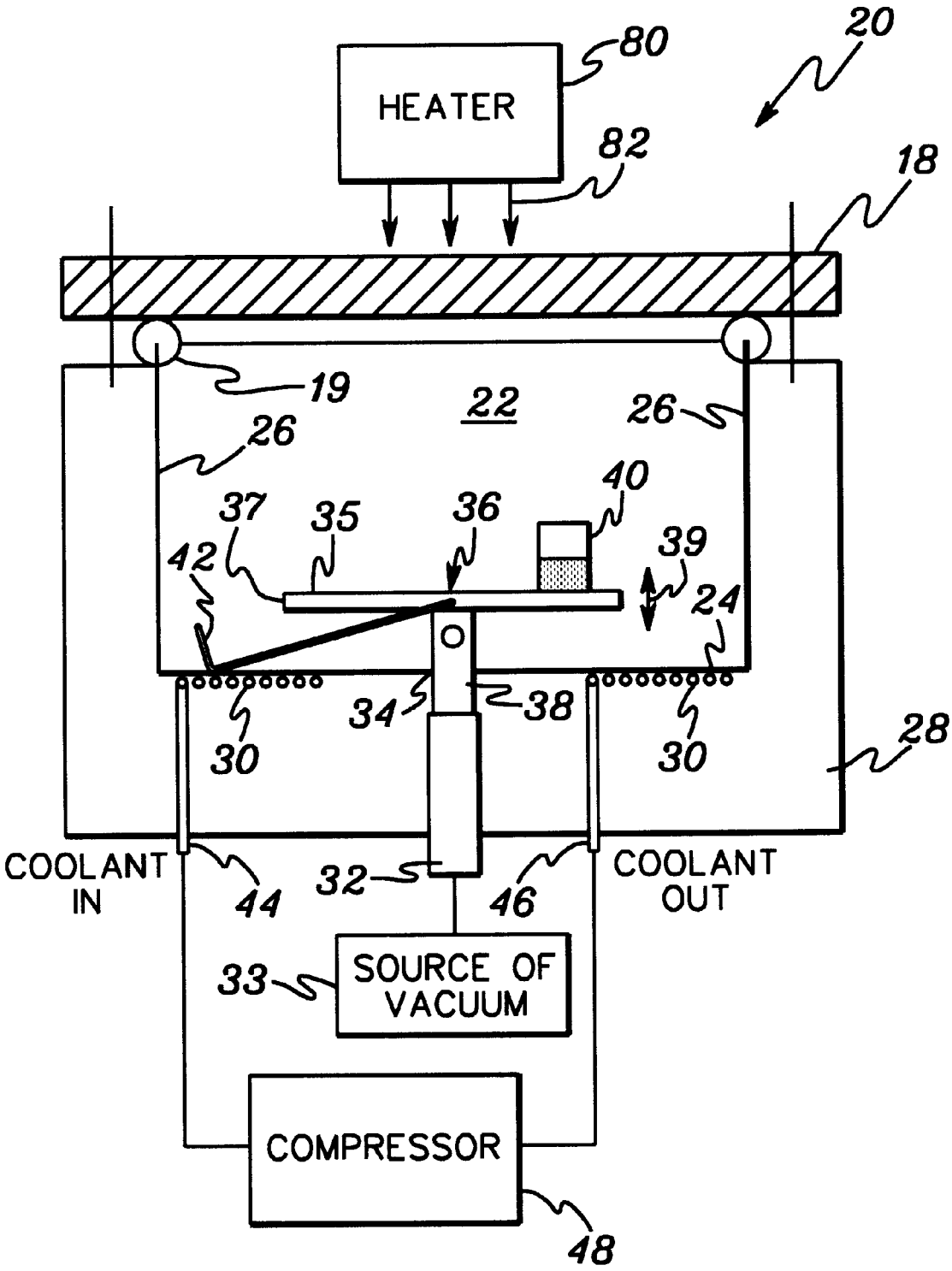
FIG. 2 is a cross-sectional view of working chamber of the device shown in FIG. 1 illustrating one aspect of the present invention.

A cross-sectional view of the chamber assembly 20 of freeze-dryer 10 illustrating one embodiment of the present invention is shown in FIG. 2. Chamber assembly 20 is mounted within housing 12 of FIG. 1 by conventional means, for example, by means of fasteners and appropriate support, and provided with appropriate conduits and electrical connections (all not shown). The chamber assembly 20 comprises a cylindrical chamber, or shallow bottom pan, 22 having a base with an interior surface 24 and side walls 26. The base interior surface 24 and walls 26 are typically metallic, for example, made of carbon or stainless steel. The interior surface 24 and walls 26 typically comprise one integral assembly, for example, a metal bowl or can-like construction. The chamber 22 is preferably insulated on its sides and bottom by means of insulation 28. Chamber 22 is typically right circular cylindrical in shape but may take any cylindrical form, including non-circular such as square cylindrical and rectangular cylindrical, among others. The chamber 22 is typically accessible from the top and is typically isolated from the ambient environment by cover 18. The chamber 22 is cooled by cooling heat-exchanger coils 30. The pressure within chamber 22 is varied, typically reduced, by means of a vacuum source 33 operatively connected to conduit 32 which passes though the insulation 28 at the bottom of the assembly 20. The conduit 32 may also be located in the walls 26 of chamber 22. The vacuum source 33 typically provides an absolute pressure of between about 1 and about 100 millitorr (that is, about 1.33 to about 133 microbars), preferably between about 5 millitorr and about 25 millitorr (that is, between about 6.65 microbars and about 33.25 microbars) in chamber 22. The vacuum source 33 is typically a vacuum pump, for example a 2-stage, direct-drive vacuum pump, supplied with built-in gas ballast and anti-"suckback" valves for wear protection. The vacuum pump has a capacity of at least about 20 liters per minute, but typically has a capacity of at least 50 liters per minute, that is, for a 1 to 5 kilogram capacity freeze dryer.

According to the present invention, conduit 32 may also function as a drain for removing condensate after the freeze-drying process is completed. In having the conduit 32 function as both the vacuum source conduit and the drain conduit, the present invention limits the number of access ports in chamber 22 to only one port. Of course, more than one port may also be used for the source of vacuum, drain, or other functions as needed.

According to the present invention, the chamber includes a moveable specimen holder, or baffle plate, 36 having a rim 37, mounted on a perforated tube 38 on which products or specimens 40 can be placed for freeze-drying. The perforated tube 38 slidably engages (for example, "telescopes" within) the conduit 32, that is, the tube 38 slidably engages the same conduit 32 through which the source of vacuum communicates with the chamber 22. The movement of the specimen holder 36 is identified by the double arrow 39. The specimen holder 36 is supported at its desired elevation by rigid, bent, metal wire 42. As more clearly seen in FIG. 3A, wire 42 rotatably engages the rim 37 of specimen holder 36. Three representative positions of the specimen holder 36 and wire 42 according to the invention are shown in FIGS. 4A, 4B, and 4C.

The cooling heat-exchanger coils 30 are located beneath the base interior surface 24 of chamber 22. These cooling coils can provide several functions, including the source of cooling for the initial freezing phase of the freeze-drying process, the source of cooling for the condenser surface during the drying phase, and the source of cooling when the chamber 22 is used as a "cold trap". In the freeze-drying process the surface of the means of cooling should be capable of reaching temperatures approximately 20 degrees C. colder than the temperature of any frozen solvent surface in the specimen, for example, between about minus 10 to about minus 110 degrees C. The surface of cooling device is typically lower than minus 40 degrees C. The coils 30 can be located directly beneath base interior surface 24, that is, in contact with base 24, to ensure that the interior surface 24 and, when the specimen holder 36 is in contact with interior surface 24, the specimen holder 36 and specimen 40 are cooled by direct conduction of heat. This contrasts with some prior art in which cooling coils are mounted about the outside diameter of the chamber and the specimen is typically cooled by radiant cooling and convection cooling and not by direct conduction. The conduction cooling of the present invention permits more efficient cooling, and cooling to lower temperature than can be achieved by the prior art. The coils 30 may be attached to the base 24 by any conventional means, for example, by soldering, brazing, welding, adhesives, or mechanical fasteners, among other methods. The cooling coils 30 may also be imbedded in the base of the chamber 22, for example, the cooling coils 30 may be provided by passages machined into the base of the chamber 22, or the cooling coils 30 may be imbedded into a thermally-conductive material which provides a thermally-conductive path to the interior surface 24. Refrigerant, for example, CFC-free refrigerant is introduced to the coils 30 by means of conduit 44 and removed via conduit 46. Typical refrigerants that can be used for the present invention include those having international designations R403B, R404A, R507, R89 and their equivalents, manufactured by Dupont, Allied Chemical, and Rhone Poulence, among others. The refrigerant removed via conduit 46 is typically passed to a compressor 48 where the refrigerant is compressed and then reintroduced to the coils 30 via conduit 44. The coils 30 may take any appropriate shape, for example, the coils may be arranged in a circular or rectangular pattern. The coils 30 are preferably arranged in a spiral pattern wound from the center outward or from the outside inward. In addition, instead of coils, a heat-transfer surface could be mounted beneath the base surface 24 by means of welding or mechanical fasteners, such as threaded bolts. Also, the freezing step may be performed in an external process and not in freeze-dryer 10, for example, in an external dry-ice bath or in a laboratory freezer.

The cover 18 is typically circular in shape and provides a cover to the open top of chamber 22. The cover 18 may be metallic (for example, stainless steel) but is typically non-metallic (for example, clear acrylic or opaque plastic), but any appropriate material can be used including glass, polycarbonate, and polysulfone, which may be transparent, translucent, or opaque. The cover 18 can simply be held in place by the vacuum present in the chamber, but the cover 18 may also attached to the chamber housing 20 by conventional means, for example, by means of mechanical fasteners, such as threaded bolts or clamping devices. Some sort of sealing means 19 is provided at the interface of the cover 18 and the upper rim of the side walls 26 of chamber 22. This sealing means 19 typically comprises some form of flexible material, for example, an elastomeric material, such as neoprene, silicone, ethylene-propylene rubbers, for example, those manufactured by Dupont and GE, among others. Since the chamber assembly 20 will typically be exposed to temperatures of minus 40 degrees C., or less, the sealing means material is preferably a material that can operate and effectively function at such low temperatures without failure. The sealing means 19 may take the form of a flat flexible gasket, or, as shown in FIG. 2, the sealing means 19 may be circular in cross-section and partially split so that the slit in the sealing means engages the upper rim of side walls 26. A vacuum-compatible grease, for example, Dow-Corning vacuum grease, is preferably applied to the contact surface of the sealing means 19.

During the sublimation process, the sample 40 may be heated to promote sublimation. Though the ambient radiation downward through the cover 18 may provide sufficient heat, according to the present invention it is sometimes desirable to provide a heater dedicated to heating the specimen during sublimation, for example, radiant heater 80 shown in FIG. 2 which directs heat through the cover 18 as indicated by arrows 82 to heat sample 40.

Figure 3A:
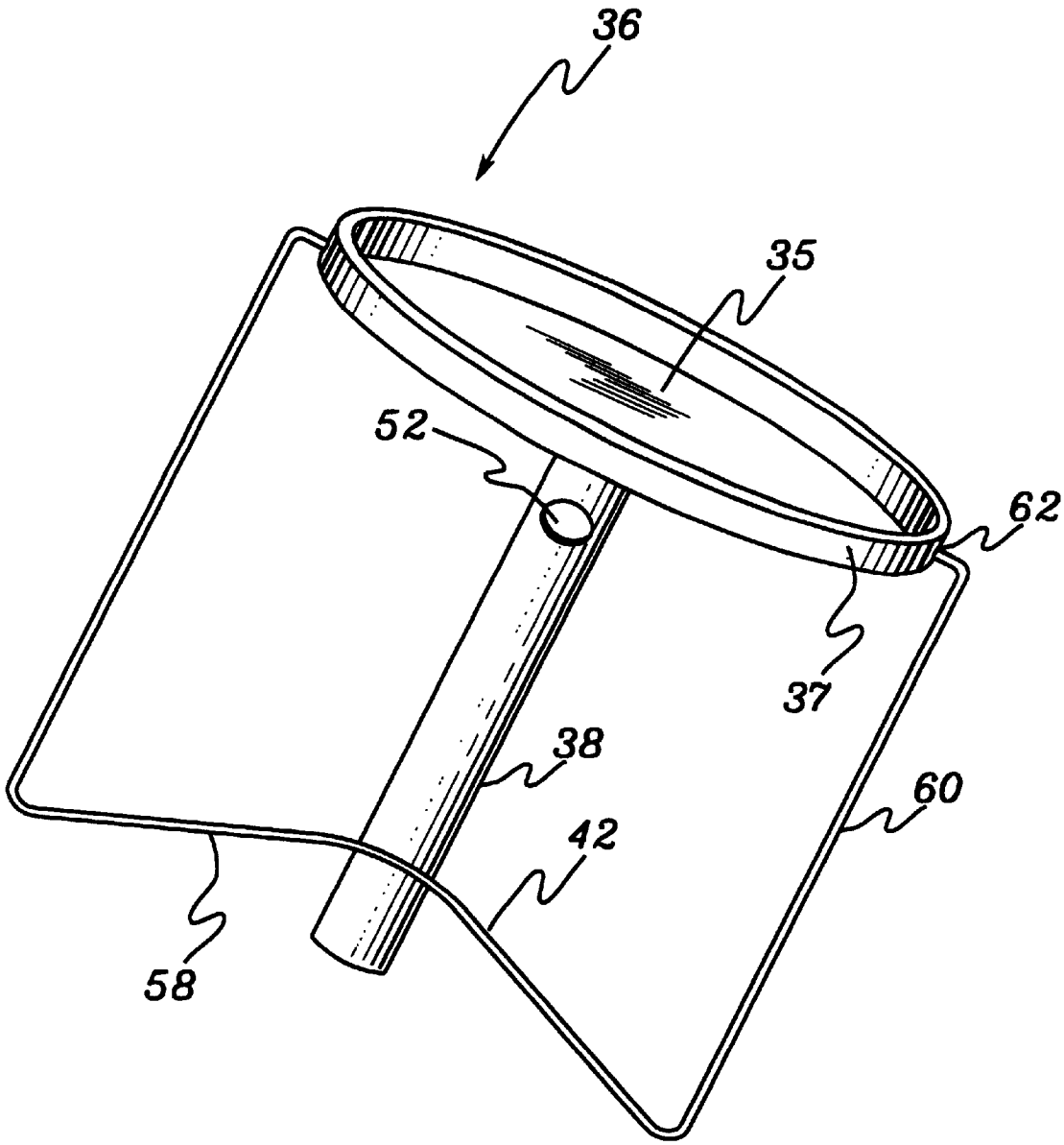
FIGS. 3A, 3B, and 3C illustrate an isometric view, a top view, and a side elevation view of the specimen holder shown in FIG. 2.
Figure 3B:
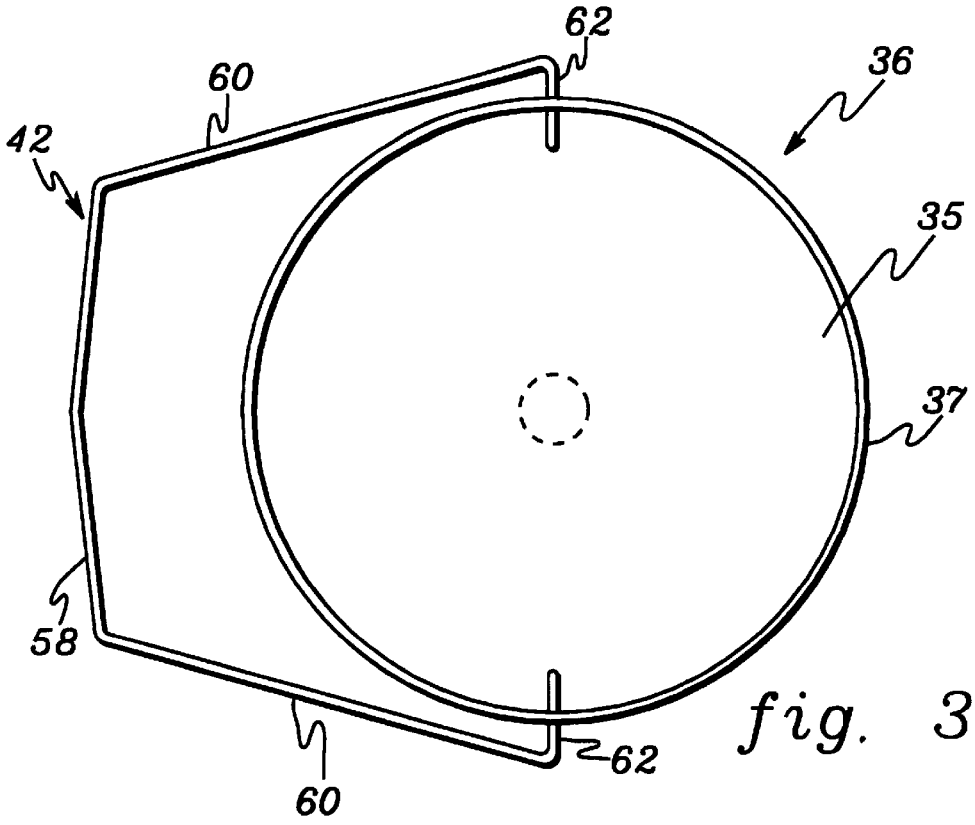
Figure 3C:
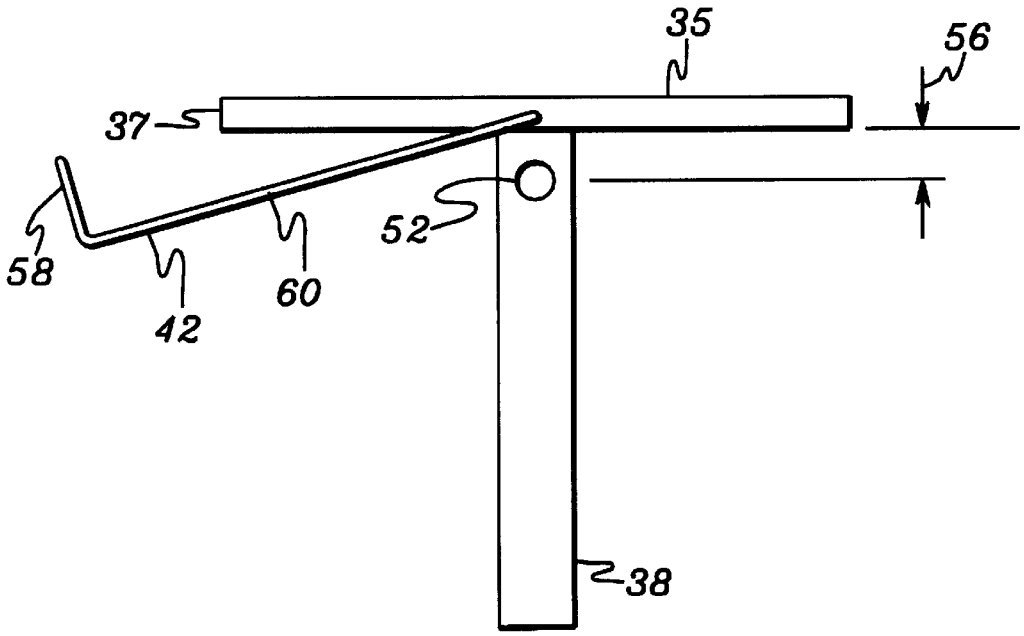
Figure 4A:
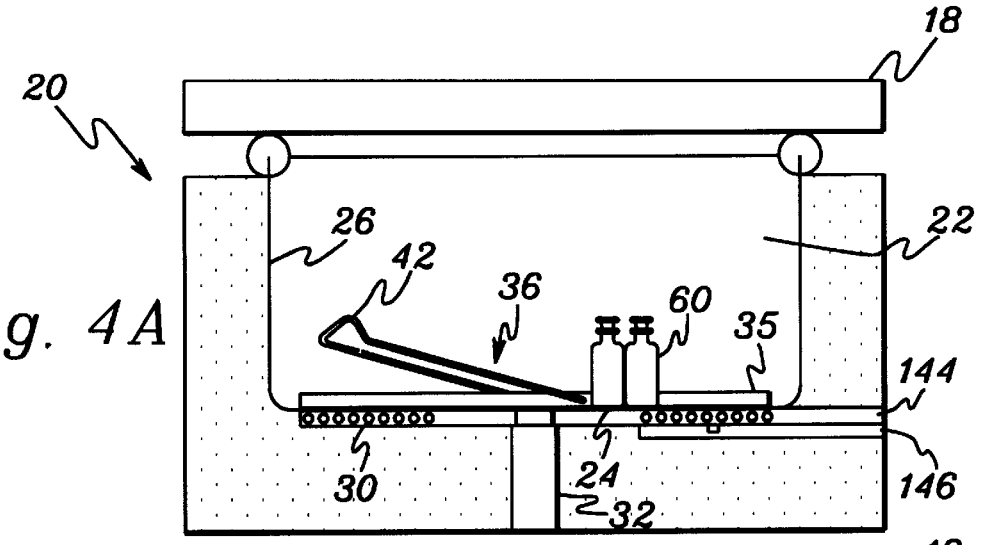
FIGS. 4A, 4B, and 4C are cross-sectional views as in FIG. 2 showing alliterative positions of the specimen holder.
Figure 4B:
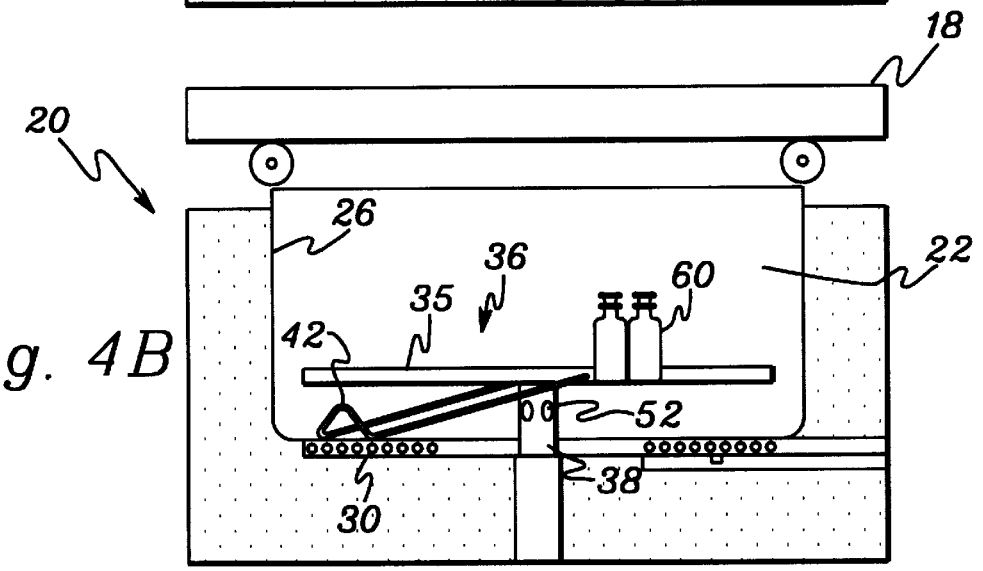
Figure 4C:
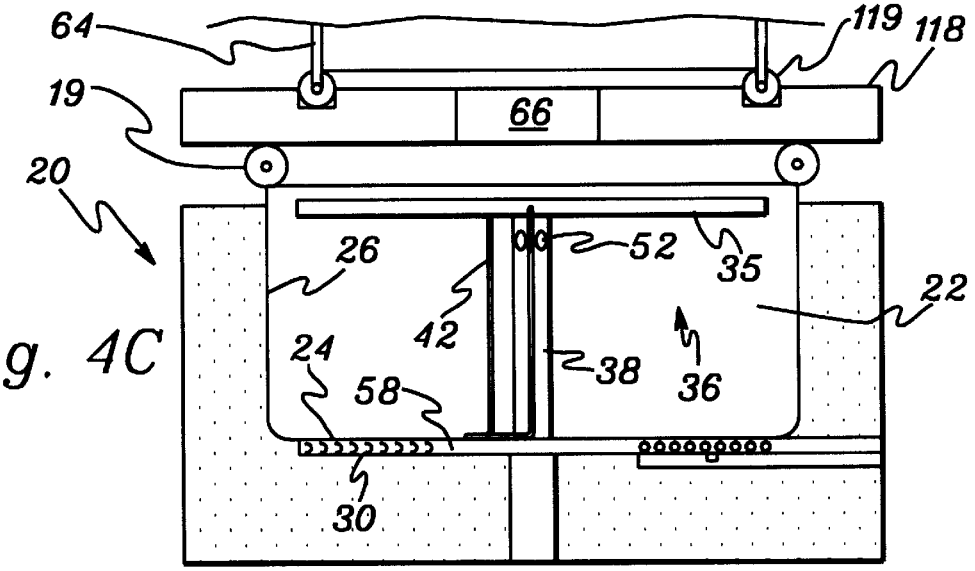

Detailed views of the moveable specimen holder 36 in FIG. 2 are shown in FIGS. 3A, 3B, and 3C. FIG. 3A illustrates an isometric view of specimen holder 36. FIG. 3B illustrates a top view and FIG. 3C illustrates a side elevation view of specimen holder 36. The specimen holder 36 includes a specimen tray 35 and a support tube 38. Though circular in shape in these figures, the specimen tray 35 may take any shape, such as square, triangular, or rectangular, while still fitting within the chamber 22 of FIG. 2. The specimen tray 35 is typically metallic, for example, stainless steel or copper, to ensure that it will conduct heat. The specimen tray 35 includes a rim or lip 37 which aids in retaining specimens or products on the specimen tray 35 during treatment. Of course, the rim 37 may be omitted without detracting from the function of the specimen holder 36 according to the present invention. The specimen tray 35 of specimen holder 36 may have a diameter between about 3 inches to 2 feet, but is preferably between about 4 inches to about 12 inches in diameter. The only limitation in the upper size of the diameter of the specimen tray 36 is that the specimen holder 36 fit into chamber 22 of FIG. 2. The width dimension of specimen tray 35, for example, its diameter, is typically about 25–75% of the width of chamber 22. The rim 37 may vary in height from about 0.125 inches to about 2 inches, but is preferably between about 0.25 inches to about 1 inch in height.

According to the invention, the specimen tray 35 is rigidly mounted on a perforated tube (for example, a conduit or post) 38. This tube 38 is preferably circular in cross section, though it may have any cross-sectional shape, including square, rectangular, and triangular, among others. However, according to the present invention, the cross-sectional shape of tube 38 should be compatible with the cross-sectional shape of conduit 32, shown in FIG. 2, to ensure that tube 38 can slidably engage conduit 32. When handling solvents that liquify, it is typically preferable to include some form of sealing means (not shown) between the outside diameter of tube 38 and the inside diameter of conduit 32. This sealing means, for example, one ore more o-ring-type seals placed in one or more o-ring grooves in the outside diameter of conduit 38, prevents the passage of gases through the annular space between the outside diameter of conduit 38 and the inside diameter of conduit 32. This sealing means ensures the flow path for gases toward source of vacuum 33 is limited to the holes in conduit 38 and also prevents the flow of gases back toward the specimen 40 (that is, the sealing means prevents gas reflux). When an o-ring-type seal is used, the o-ring material may be any conventional o-ring material, but due to the working temperature of the chamber 22 (that is, typically minus 40 degrees C. or below), the o-ring material is preferably a material that is tolerant of these lower temperatures, for example, neoprene, silicone, and ethylene-propylene rubbers, among others.

The sealing means between conduits 32 and 38 may also provide support for specimen holder 36 so that no further support is necessary. For example, the sealing means between conduit 32 and tube 38 may comprise one or more o-ring-type seals that provide sufficient friction to support specimen holder 36 such that spring clip 42 (in FIG. 2) is not necessary.

The width dimension, for example, outside diameter, of tube 38 may vary from about 0.125 to about 3 inches, but is preferably between about 0.25 inches to about 1.0 inch. The width dimension of tube 38 is typically about 5% to about 20% of the width dimension, for example, outside diameter, of specimen holder 36, preferably about 8% to about 12% of the width dimension of specimen holder 36. The length of tube 38 may vary from about 2 inches to about 2 feet, depending upon the size of the chamber assembly, but is typically from about 3 to about 12 inches in length. The tube 38 may be rigidly attached to of specimen tray 35 by any conventional means, for example, by welding or by mechanical fasteners.

According to the invention, the perforated tube 38 includes at least one perforation or hole 52, though more than one perforation is preferred. The perforations are preferably circular in shape, though any shape of perforation may be used, including square, rectangular, oval, and slotted, among others. Preferably, due to ease of manufacture, the perforations are provided as two, oppositely-positioned perforations at each elevation—since a drill can be passed through both sides of the conduit in one operation. However, one or more perforations, for example, four or more perforations, may be located at any one elevation of tube 38. The size and vertical location of the perforations may be constant or the size and vertical location of the perforations may vary. The size of perforations 52 is dependent upon the diameter of the tube 38 and the desired gas flow through the perforations. However, the diameter of perforations 52 may vary anywhere from about 20% to about 80% of the diameter of the tube 38, but is preferably between about 30% to about 50% of the diameter of tube 38. For example, in the embodiment shown in FIG. 3C, the tube 38 has an outside diameter of about 0.625 inches and the holes 52 have a diameter of about 0.25 inches (that is, 40% of the diameter).

The relative elevation of the holes 52 may vary. As shown in FIG. 3C, perforations 52 may be positioned at a distance 56 from the bottom of specimen tray 35. Perforations 52 may also be located at two or more elevations. In the specific embodiment shown in FIG. 3C, the conduit 38 includes one set of four holes 52 equally spaced around the circumference of conduit 38 having their centers at a distance 56 of about 0.5 inches from the bottom of tray 35.

FIGS. 3B and 3C also show the bent metal wire or "spring clip" 42 that can be used to support specimen holder 36 at its desired elevation. Wire 42 is typically about 0.125 inches in outside diameter, though wire having an outside diameter ranging from about 0.0625 to about 0.25 inches may be used. Though many shapes of wire may be used to effect the desired support function, wire 42 is typically symmetric and includes a mid-span 58 and side pieces 60 and 62. As shown in FIG. 3C, mid-span 58 projects in a relatively perpendicular direction from the plane of the side pieces 60. The short side stem pieces 62 are inserted into corresponding holes in rim 37 of tray 35 so that wire 42 is rotatable about the axes of stem pieces 62. In this way, the orientation of wire 42 relative to tray 35 may be varied to provide support for specimen holder 36 at different elevations. This will be more clearly illustrated with respect to FIGS. 4A, 4B, and 4C.

The positioning of specimen holder 36 and support wire 42 within the chamber assembly 20 according to the invention is illustrated in FIGS. 4A, 4B, and 4C. FIG. 4A shows specimen holder 36 in its lowest-most position with the chamber 22 when the bottom of the tray is in contact with base interior surface 24 of chamber 22. In this position, the conduit 32 leading to the source of vacuum 33 is essentially covered by specimen tray 35. While in the position shown in FIG. 4A, the samples 60 can be cooled to a temperature below the freezing temperature of the solvent in the sample. In accordance with one aspect of the invention, in this position, the bottom of tray 35 is in relatively direct thermal contact with the cooling coils 30, that is, with little or no air-gap between them, heat may pass from the samples 60 to tray 35 to base interior surface 24 and to coils 30 by direct conduction. The coolant in coils 30 is provided and removed by conduits 144 and 146, respectively. Again, this direct conduction of heat away from the samples 60 can provide for a more rapid cooling of samples 60 and provide for cooling to a colder temperature than the prior art. While in the position shown in FIG. 4A the support wire 42 is not used, it is simply rotated upward away from the base of the chamber 22. Of course, freezing can be practiced in chamber 22 without the tray 36 in place; the sample container can be placed directly on the cooled interior surface 24 of chamber 22.

FIG. 4B illustrates a second position of specimen holder 36 as supported by wire 42. In this position, wire 42 is rotated in a counter-clockwise direction relative to its position shown in FIG. 4A. (Note that if the wire 42 is rotated in a clock-wise direction from the position shown in FIG. 4A, the wire 42 can support tray 36 at an alternate elevation, for example, between the elevations displayed in FIGS. 4A and 4B.) Though wire 42 may be held in the position shown in FIG. 4B and support tray 36 by some form of restriction to the rotation of wire 42, for example, by means of some form of detent, the unique design of wire 42 permits it to bear against the walls 26 of chamber 22 as shown. In the position shown in FIG. 4B, the present invention allows for room above tray 36 for placing samples to be treated while allowing room below tray 36 for condensation on interior surface 24.

In the position shown in FIG. 4B, of specimen holder 36 is raised above interior surface 24 wherein the holes or perforations in perforated tube 38 are exposed and chamber 22 is in fluid communication with the source of vacuum 33 (in FIG. 2) via conduit 32, tube 38, and holes 52. In this position, with exposure to the source of vacuum 33, the drying phase or phases of the freeze-drying process can be practiced. When pressure at which the frozen solvent sublimates is reached, the vaporized solvent is drawn off specimen 60 and toward the source of vacuum 33. Heat may also be typically introduced to the sample to promote and control sublimation. In its simplest aspect, heating of the sample can be effected by radiant heating from the ambient environment. That is, the ambient room temperature may provide sufficient heat though cover 18 to promote the desired sublimation. However, heating of the sample may also be provided by an external heating source, such as a radiant heater positioned above cover 18. Heat may also be introduced via a dedicated heat exchanger, such as a heating coil, mounted in the walls of chamber 20. The sample may also be heated by heating the specimen holder 36 itself, for example, by means of electric heating coils attached to the specimen holder. The cooling coils 30 cool the interior surface 24 (again, more effectively by means of conduction) and provide a condensing surface upon which the gaseous solvent can condense and, ideally, little or no gaseous solvent is drawn into the vacuum source or into the warmer conduits that lead to the vacuum source. Condensation of the solvent in the conduits leading to the vacuum source 33, for example, a vacuum pump, or in the vacuum source is undesirable and should be avoided to ensure continued operation of the freeze-dryer.

According to the present invention, the potential for condensing solvent in the conduits leading to the vacuum source 33 or in the vacuum source 33 is minimized by the relative location of the condensing surface to the source of vacuum. In prior art freeze dryers, the gaseous solvent is typically not drawn across a large condensing surface by the source of vacuum. For example, in prior art devices having a vacuum port located in the side wall of the treatment chamber and having exposed condensing coils mounted about the periphery of the chamber, the flow path of the gaseous solvent en route to the source of vacuum passes over a cooled surface of limited area onto which solvent can condense (that is, the cooling coils in the vicinity of the vacuum port). However, according to the present invention, the flow path of the gaseous solvent passes over a larger, more uniform cooled surface onto which solvent can condense. That is, according to the present invention, the gaseous solvent leaving a sample mounted on specimen holder 36 follows a flow path about the outside diameter of tray 35 and then radially inward toward the centrally-located conduit 32. In doing so, the gaseous solvent is exposed to the larger surface area of the cooled interior surface 24 prior to passing into conduit 32. As a result, according to the present invention, condensation of the gaseous solvent is more likely and more effective and the flow of gaseous solvent out of the chamber to the vacuum source is minimized.

Upon completion of the freeze-drying process, and removal of cover 18, fully-treated samples in sample holder 60, and specimen holder tray 36, the condensate remaining in chamber 22, for example, on the base 24, can be removed by flushing with warm water. The condensate may also be simply allowed to melt upon exposure to ambient room temperature. During flushing or melting, conduit 32 also acts as a drain for directing the condensate and water to appropriate disposal. In addition, as will be discussed more completely below, according to one aspect of the present invention, when the vacuum in chamber 22 is removed, any solid condensate, for example, ice, present on the base 24 may be dislodged with the increase in pressure and simply lifted out.

FIG. 4C illustrates a third possible position for the moveable specimen holder 36 according to the present invention. The moveable specimen holder 36 may be supported in this position by wire 42. In this position, the mid-span member 58 (see FIG. 3A) bears against interior surface 24 of chamber 22 and the tray is positioned at its relatively highest elevation above interior surface 24. In this position, the wire members 60 are essentially perpendicular to interior surface 24 and specimen holder 36 and holes 52 are exposed to the chamber. As a result, the maximum flow of gas from chamber 22 toward vacuum source 33 can be obtained and the maximum solvent sublimation and condensation can be achieved. Also, while the specimen holder 36 is in the position shown in FIG. 4C, the space provided below tray 36 for condensation to form is at a relative maximum.

The position of specimen holder 36 shown in FIG. 4C is typically amenable to the drying of specimens mounted in a manifold chamber 64, and not to samples, such as samples 60, placed on specimen holder 36. For example, the position of specimen holder 36 in FIG. 4C is typically used for treating samples on trays mounted in chamber 64 or for treating sample bottles (not shown) mounted to chamber 64 as is conventional in the art. Unlike the devices shown in FIGS. 4A and 4B, the freeze-drier shown in FIG. 4C includes a cover 118 having one or more orifices or holes 66 that lead to chamber 64. A seal 119 is provided between cover 118 and working chamber walls 26 in a manner similar to seal 19 shown in FIG. 2. The vacuum source 33 communicates with the manifold chamber 64 via conduit 32, tube 38, holes 52, and hole 66.

Though the position of specimen holder 36 in FIG. 4C is typically used for treating samples mounted in or attached to manifold chamber 64, the freeze-dryer shown in FIG. 4C has the same advantages of the devices shown in FIGS. 4A and 4B.

Figure 5:
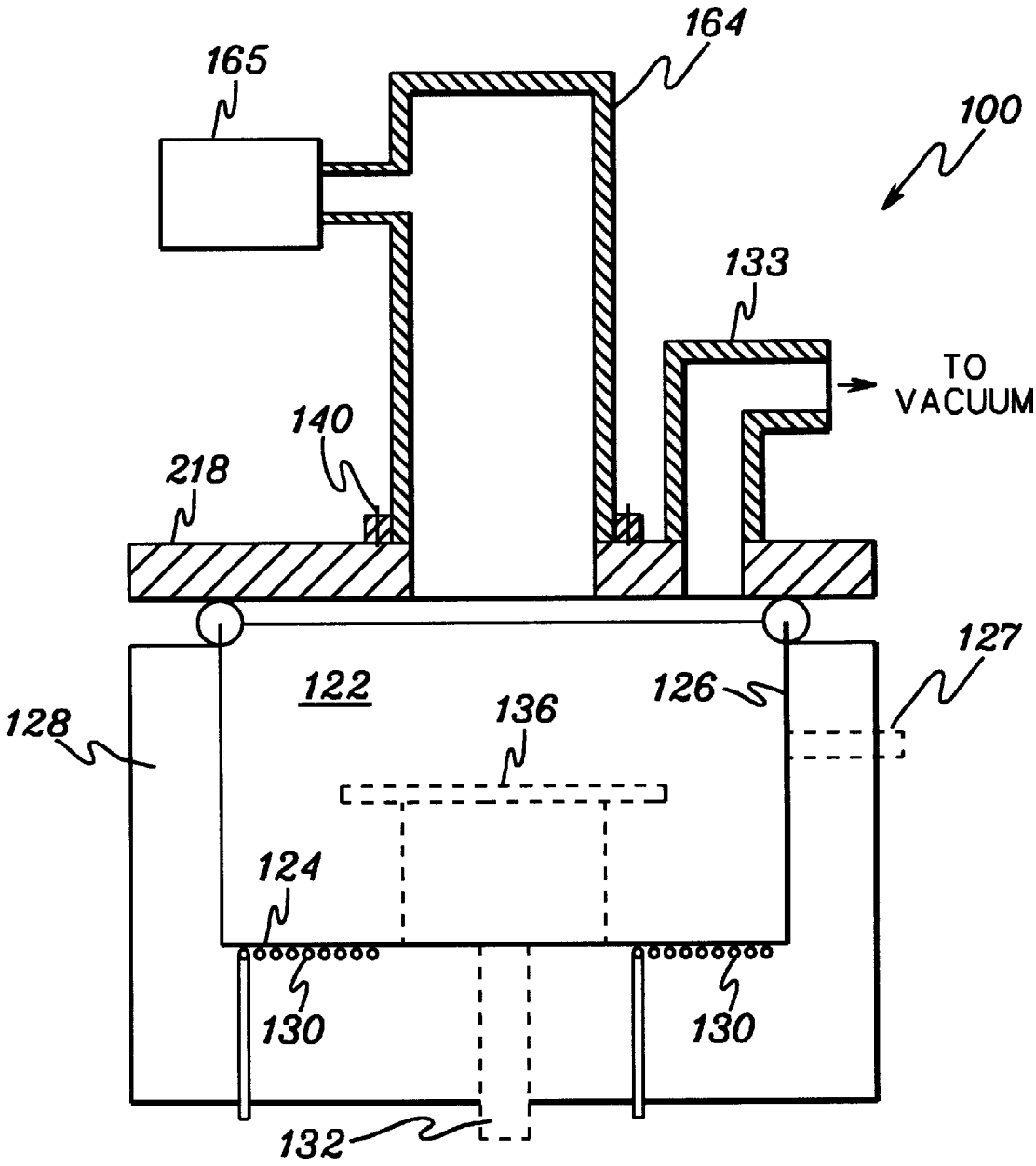
FIG. 5 is a cross-sectional view of working chamber of the device shown in FIG. 1 illustrating another aspect of the present invention.

A further aspect of the present invention is illustrated in FIG. 5. FIG. 5 illustrates a cross-sectional view of a freeze dryer chamber assembly 100 which is similar to freeze dryer chamber assembly 20 shown in FIGS. 1, 4A, 4B, and 4C. Similar to the earlier chamber assemblies, chamber assembly 100 includes a cylindrical chamber 122 having a base with interior surface 124, side walls 126, a cover 218, insulation 128, and cooling heat-exchanger 130. Though the cover 218 may be a solid cover similar to cover 18 shown in FIG. 2, cover 218 may also include a manifold assembly 164 having one or more sample flasks 165 containing samples to be freeze dried as is conventional in the art. The sample flasks 165 are in fluid communication with chamber 122 via manifold 164 and a hole 166 in cover 218. Manifold 164 is attached to cover 218 by conventional means 140, for example, by mechanical fasteners. The characteristics of chamber 122, side walls 126, insulation 128, heat-exchanger 130, and cover 218 are essentially the same as those structures described above.

However, unlike the earlier chamber assemblies, chamber assembly 100 is characterized by chamber 122 having a base with interior surface 124 which is devoid of any holes, perforations, obstructions, or any other features that would interfere with the formation or removal of solids or liquids that may condense on the surface. In particular, no drains or vacuum ducts, for example, conduits similar to conduit 32 in FIG. 2, are located in the interior surface 24. In this aspect of the invention, Interior surface 124 is essentially "clean and flat". One advantage of eliminating the presence of any holes, conduits, or orifices in interior surface 124 is that when collecting liquid solvent, no path for undesirable leakage, for example, into a drain or vacuum port, is present. In addition, unlike the earlier aspects of the invention, in one aspect of the invention shown in FIG. 5, the chamber 122 is devoid of any holes or perforations within the chamber 122. That is, in this aspect of the invention, no vacuum ports are located in the bottom surface 124 or side walls 126 of chamber 122. According to this aspect, the source of vacuum is operatively connected to the interior of chamber 122 via conduit 133 located in the cover 218.

The aspect of the invention shown in FIG. 5, may be used to practice various treatments, including as a condensing device and as a freeze drying device. For example, with or without the presence of a manifold 164, samples can be placed upon the interior surface 124 of chamber 122 to freeze the sample by means of cooling coils 130. In addition, after the sample has been frozen within the chamber 122 or externally of the chamber 122, the sample can be freeze dried while positioned at various locations, including on the interior surface 124, while located in one or more sample flasks 165, or while placed on a specimen holder, for example, specimen holder 136 shown in phantom in FIG. 5. For example, when the same is located in one or more flasks 165, the chamber 122, or shallow bottom pan, is effectively empty and functions as a condenser and collects the solvent that condenses on interior surface 124. As in earlier embodiments, when chamber assembly 100 is used as a freeze dryer, the interior surface 124, which is cooled by cooling heat-exchanger 130, functions as a condensing surface for any solvent released from the sample during the treatment process, regardless of where the sample is located.

As noted earlier, upon completion of the freeze drying process during which a solid or liquid condensate typically forms upon the interior surface 124, the solid or liquid condensate must be removed from chamber 122. However, the chamber assembly 100, having an unperforated and unobstructed interior surface 124 upon which condensate forms, provides a advantageous feature that facilitates removal of condensate, especially removal of solid condensate. According to the present invention, when the freeze drying process is completed, and the vacuum released from chamber 122, the interior surface 124 deflects with the release of the vacuum and in so doing dislodges at least some, typically all, of the solid condensate that may have formed during the drying process and can be easily removed. In most instances the entire ice cake formed is broken loose with the release of vacuum and is easily removed. This deflection of the surface 124 and the dislodging of the solid condensate, or "instant defrost", has been shown to be a very advantageous feature compared to prior art devices which, for example, have interior condensation surfaces which are obstructed by heat exchanger coils, conduits, or orifices of some kind. Removing condensate from such prior art devices has been shown to be messy and time consuming. It is believed that these obstructions or perforations in, on, or near the base or side walls of the prior art either provide surfaces to which the condensate can adhere, and thus encumbers removal, or provides stiffness to the interior surface which prevents the surface from deflecting upon release of vacuum. In either case, the aspect of the present invention disclosed in FIG. 5 provides a marked improvement in the ease with which condensates, solid or otherwise, can be removed from the chamber.

Though in the above aspect of the invention, no orifices or holes appear in the interior surface 124 or side walls 126, another aspect of the invention includes such features. For example, the chamber assembly 100 shown in FIG. 5 may include holes or conduits 132 (shown in phantom) in the interior surface 124. Conduit 132 may simply be a drain, a vacuum port, or as discussed below with respect to FIG. 6, a sleeve for supporting a specimen tray. Though conduit 132 is located essentially in the center of chamber 122 in FIG. 5, the present invention also includes locating conduit 132 anywhere in the interior surface 124, for example, off-center or adjacent side walls 126. Though in the prior art, the presence of an orifice or conduit similar to 132 typically interferers with the deflection of the interior surface 124, which can facilitate condensate removal as discussed above, it should be understood that in the present invention, the design of the conduit 132 and its interface with the interior surface 124 can be designed to allow the interior surface 124 to be deflectable.

The present invention also includes the chamber 122, cooling coils 130 and condensing surface 124 shown in FIG. 5 while also including one or more orifices or conduits 127 (shown in phantom) in the side walls 126. That is, though in one aspect described above no such orifices or conduits are present, the benefits of the present invention can also be provided while having one or more orifices or conduits 127. Orifice or conduit 127 may be used for various purposes as dictated by the desired treatment, for example, as a source of vacuum in lieu of or in conjunction with conduit 133.

Figure 6:
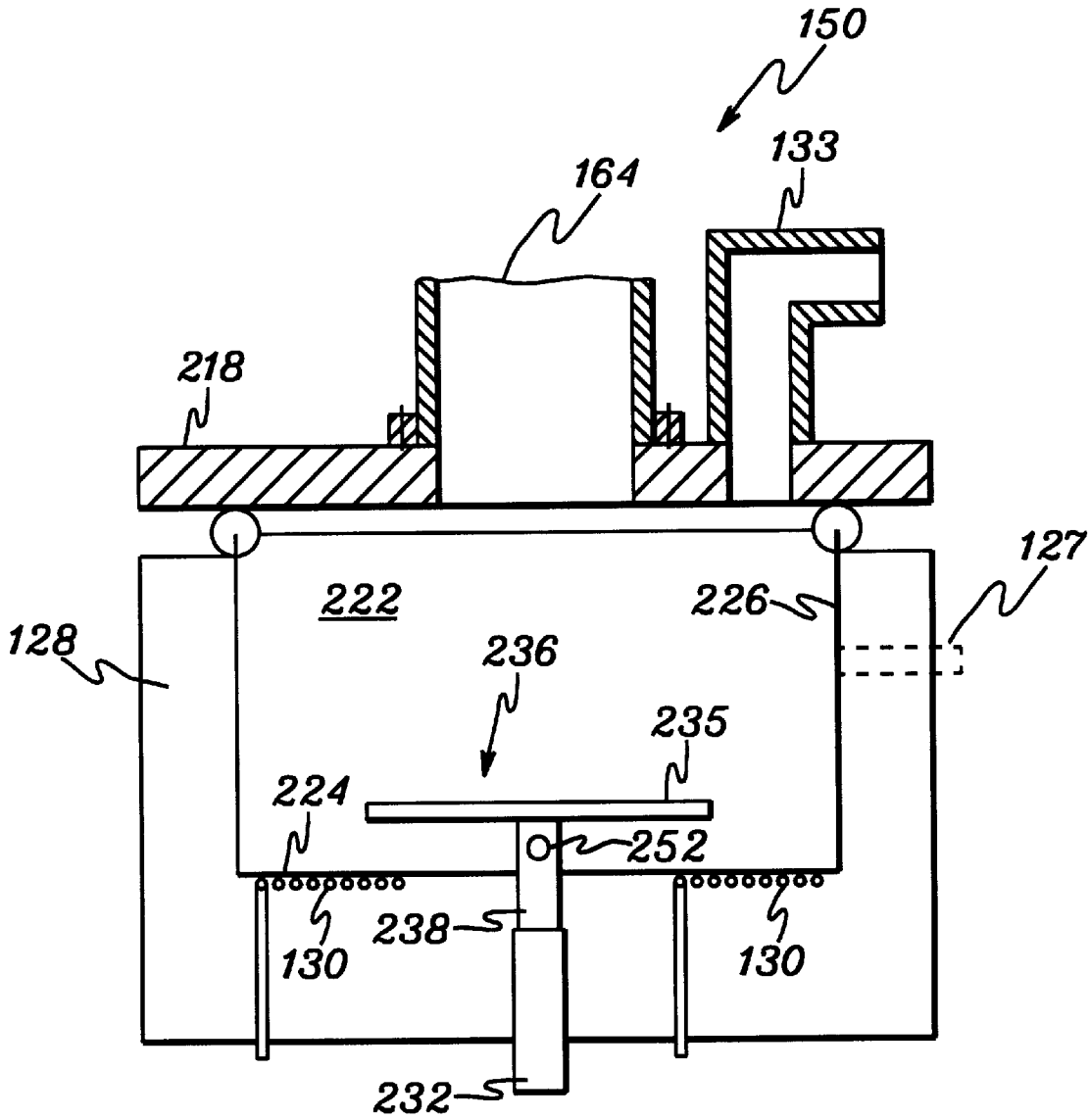
FIG. 6 is a cross-sectional view of working chamber of the device shown in FIG. 1 illustrating a further aspect of the present invention.

A further aspect of the present invention is shown in FIG. 6. FIG. 6, like FIG. 5, illustrates a cross-sectional view of a freeze dryer chamber assembly 150 which is similar to freeze dryer chamber assembly 20 shown in FIGS. 1, 4A, 4B, and 4C. Again, similar to the earlier chamber assemblies, and as in FIG. 5, chamber assembly 150 includes a cylindrical chamber 222 having a base with interior surface 224, side walls 226, a cover 218, insulation 128, and cooling heat-exchanger 130. In the aspect shown in FIG. 6, the interior surface 224 includes an orifice or conduit 232. Though the cover 218 may be a solid cover similar to cover 18 shown in FIG. 2, cover 218 in FIG. 6 may also include a manifold assembly 164 as in FIG. 5. The characteristics of chamber 222, side walls 226, insulation 128, heat-exchanger 130, and cover 218 are essentially the same as those structures described above. Chamber 150 may be operated in a manner similar to the operation of chamber 100 as described above, for example, simply as a condensing device or as a freeze-drying device.

However, unlike chamber assembly 100 in FIG. 5, chamber assembly 150 of FIG. 6 also includes a moveable specimen holder 236, that is, a specimen holder 236 that is essentially the same as specimen holder 36 shown in FIGS. 3A, 3B, and 3C. Specimen holder 236 includes a specimen tray 245 mounted on a support tube 238 having one or more perforations 252. The specimen holder 236 may also have a wire support (not shown). Also, as discussed above, according to the present invention, the support tube 238 slidably engages conduit 232 in a fashion essentially the same as described for conduits 38 and 32 shown in FIG. 2. The operation of chamber 150 is essentially the same as the operation of chamber 20 shown in FIGS. 4A, 4B, and 4C. However, in the aspect disclosed in FIG. 6, though the conduit 232 can be used as the source of vacuum, the conduit 232 is typically not used to provide a source of vacuum. The source of vacuum is typically provided via conduit 133 in the cover 218 or (optionally) via a conduit 127 (shown in phantom) in the side wall 226. Conduit 232 may be use as a drain port if desired. It is to be understood, that even though chamber assembly 150 shown in FIG. 6 includes a conduit 232 and a specimen holder 236, the interior surface 224 can still be designed to be relatively free of obstructions and deflectable to provide the potential for facilitating the removal of condensate from the chamber 222 after treatment.

Though in the above figures the present invention was described with respect to the three-step freeze-drying process, it will be apparent to those of ordinary skill in the art that the present invention may also be used to simply condense liquid solvents that have been sublimated or evaporated from a sample, that is, the present invention can also be used as a "cold trap". In this embodiment, the solvent (again, typically water) removed from the sample can condense as a liquid or solid on the cooled interior surface 24 (see FIG. 2) and collect in the bottom of the chamber 22. In this "cold trap" embodiment it is preferred that a sealing means, for example, an o-ring, be present between the conduit 38 and conduit 32 to prevent liquid solvent leakage.

The freezing drying or condensing methods and apparatus described above exhibit many advantages over the methods and apparatus of the prior art. These advantages include, but are not limited to, improved cooling of the sample positioned on surface on base 24, 124, 224 due to the proximity and direct conduction provided by cooling coils 30, 130; improved condensation on the condensation surface 24, 124, 224 due to direct conduction; the minimization or the elimination of obstructions, orifices, holes or conduits from the condensing surface 24, 124, 224; the potential to use this single conduit 32, 132, 232 as a drain for flushing out condensate and other matter after treatment; and facilitating the removal of solid condensate by deflecting the condensate surface after treatment to dislodge the condensate.

While the invention has been particularly shown and described with reference to preferred embodiment, it will be understood by those skilled in the art that various changes in form and details may be made to the invention without departing from the spirit and scope of the invention described in the following claims.

What is claimed is:

1. A freeze-dryer, comprising:

a chamber having a cover, side walls and a thermally-conductive base, the base having an interior surface and a conduit therein;

a specimen holder disposed in the chamber for holding a specimen to be freeze-dried, the specimen holder having a support tube slidably engaging the conduit so as to be selectively moveable between a position in which the specimen holder is in contact with the interior surface of the base and one or more positions in which the specimen holder is not in contact with the interior surface of the base;

means mounted below the interior surface of the base for cooling the specimen; and means for reducing the pressure in the chamber by drawing a vacuum.

2. The apparatus as recited in claim 1, wherein the means for cooling the specimen cools the specimen primarily by conduction.

3. The apparatus as recited in claim 2, wherein the means for cooling the specimen comprises coolant-containing coils.

4. The apparatus as recited in claim 1, wherein the means for reducing the pressure in the chamber is a vacuum pump operatively connected to the conduit.

5. The apparatus as recited in claim 1, wherein the chamber is devoid of any internal obstructions.

6. The apparatus as recited in claim 1, wherein the specimen holder includes a means for supporting the specimen holder at the one or more positions in which the specimen holder is not in contact with the interior surface of the base.

7. The apparatus as recited in claim 6, wherein the means for supporting the specimen holder comprises a rigid wire rotatably mounted on the specimen holder.

8. The apparatus as recited in claim 1, wherein the support tube is perforated.

9. The apparatus as recited in claim 8, wherein the vacuum is drawn through the tube of the specimen holder.

10. A method for freeze-drying a specimen containing a solvent in a chamber having a base with an interior surface, the chamber having a thermally-conductive specimen holder moveable between a position in contact with the interior surface of the base and one or more positions not in contact with the interior surface of the base; means for cooling mounted beneath the interior surface of the base; and a source of vacuum operatively connected to the chamber for reducing the pressure in the chamber, comprising:

positioning the specimen holder so that it contacts the interior surface of the base of the chamber;

placing the specimen on the specimen holder;

operating the cooling means so as to cool the specimen at least by conduction to a temperature below the freezing temperature of the solvent;

moving the specimen holder to a position out of contact with the interior surface of the base of the chamber; and reducing the pressure in the chamber by activating the source of vacuum to obtain a pressure in the chamber at which the solvent will sublime to produce a freeze-dried specimen.

11. The method as recited in claim 10, wherein the step of cooling the specimen is practiced by using the means for cooling.

12. The method as recited in claim 10, wherein the specimen holder includes a perforated support tube that slidably engages the conduit and wherein the pressure reducing step is practiced by drawing at least some of the vacuum through at least one of the support tube perforations.

13. The method as recited in claim 10, wherein the specimen holder is supported by using a metal wire.

14. The method as recited in claim 10, further including, prior to or simultaneously with the pressure reducing step, heating the specimen to promote sublimation of the solvent.

15. The method as recited in claim 14, wherein the pressure reduction and heating are controlled to minimize melt back of the solvent.

16. The method as recited in claim 10, further including the step of condensing the solvent in the chamber.

17. The method as recited in claim 16, wherein condensing of the solvent is practiced on the interior surface of the base of the chamber.

18. A freeze dryer for treating a specimen containing a solvent, comprising:

a chamber having a cover, side walls and a thermally-conductive base, the base having an interior surface;

means for reducing the pressure in the chamber whereby at least some of the solvent in the specimen sublimes to form a gaseous solvent; and means mounted below the interior surface of the base for cooling the interior surface of the base to provide a condensing surface for the solvent.

19. The freeze dryer as recited in claim 18, wherein the chamber includes at least one orifice in the cover, side wall, or base and the means for reducing the pressure in the chamber is a source of vacuum operatively connected to the at least one orifice.

20. The freeze dryer as recited in claim 18, further comprising a specimen holder positioned in the chamber for holding the specimen to be freeze dried.

21. The freeze dryer as recited in claim 20, wherein the specimen holder includes a support tube and the interior surface of the base of the chamber includes at least one orifice, wherein the support tube slidably engages the at least one orifice.

22. The freeze dryer as recited in claim 18 wherein the chamber cover includes a manifold assembly.

23. The freeze dryer as recited in claim 18 wherein the cooling means comprises one or more coolant-containing coils.

24. The freeze dryer as recited in claim 19 wherein the at least one orifice is located in the side wall of the chamber.

25. A freeze-dryer, for treating a specimen containing a solvent, comprising:

a chamber for holding the specimen, the chamber having a cover, side walls and a thermally-conductive base, the base having an interior surface;

means for a reducing the pressure in the chamber whereby at least some gaseous solvent is formed;

means mounted below the interior surface for cooling the interior surface whereby at least some solvent solidifies on the interior surface during treatment; and means for deflecting the interior surface whereby the at least some solidified solvent is dislodged from the interior surface to facilitate removal of the solidified solvent from the chamber.

26. The freeze dryer as recited in claim 25, wherein the means for deflecting the base comprises a means for increasing the pressure in the chamber.

27. The freeze dryer as recited in claim 26, wherein the means for reducing the pressure in the chamber comprises a vacuum pump operatively connected to the chamber to produce a vacuum in the chamber.

28. The freeze dryer as recited in claim 27, wherein the means for increasing the pressure in the chamber comprises removing the vacuum from the chamber.

29. The freeze dryer as recited claim 25, wherein the means for reducing pressure in the chamber produces a subatmospheric pressure in the chamber.

30. A method for freeze-drying a specimen containing a solvent in a chamber having a base with thermally-conductive, deflectable interior surface; means for cooling mounted beneath the interior surface of the base; and a source of vacuum operatively connected to the chamber for reducing the pressure in the chamber, comprising:

locating the specimen in the chamber;

reducing the pressure in the chamber by activating the source of vacuum whereby at least some solvent sublimes;

cooling the interior surface of the base via the means for cooling;

condensing at least some solvent on the cooled interior surface; and deflecting the interior surface of the base whereby at least some solid condensate is dislodged from the interior surface.

31. The method as recited in claim 30, further comprising cooling the specimen to a temperature below the freezing point of the solvent prior to reducing the pressure in the chamber.

32. The method as recited in claim 30, wherein deflecting the interior surface is practiced by increasing the pressure in the chamber.

33. The method of claim 32, wherein increasing the pressure in the chamber is practiced by releasing the vacuum within the chamber.

34. A freeze-dryer, comprising:

a chamber for holding a specimen to be freeze-dried, the chamber having a cover, side-walls and a thermally-conductive base, the base having an interior surface;

means positioned below the interior surface of the base for cooling the specimen; and means for reducing the pressure in the chamber.

35. The freeze-dryer as recited in claim 34, wherein the means for cooling the specimen comprises means for cooling the specimen by conduction.

36. The freeze-dryer as recited in claim 34, wherein the means for cooling the specimen comprises coolant-containing passages.

37. The freeze-dryer as recited in claim 36, wherein the coolant-containing passages comprise one or more coolant-containing coils.

38. The freeze-dryer as recited in claim 36, wherein the coolant-containing passages define a plane substantially parallel to the interior surface of the chamber.

* * * * *